US007270189B2

(12) United States Patent
Brown et al.

(10) Patent No.: US 7,270,189 B2
(45) Date of Patent: Sep. 18, 2007

(54) TOP DRIVE ASSEMBLY

(75) Inventors: Matthew Brown, Calgary (CA); William G. Carr, Calgary (CA)

(73) Assignee: Tesco Corporation, Calgary (CA)

( * ) Notice: Subject to any disclaimer, the term of this patent is extended or adjusted under 35 U.S.C. 154(b) by 289 days.

(21) Appl. No.: 10/983,668

(22) Filed: Nov. 9, 2004

(65) Prior Publication Data

US 2006/0096751 A1 May 11, 2006

(51) Int. Cl.
*E21B 19/18* (2006.01)

(52) U.S. Cl. ..... 166/380; 166/77.52; 166/77.1

(58) Field of Classification Search ..... None
See application file for complete search history.

(56) References Cited

U.S. PATENT DOCUMENTS 3,635,105 A * 1/1972 Dickmann et al. ..... 81/57.18
4,449,596 A 5/1984 Boyadjieff
4,593,773 A 6/1986 Skeie
4,605,077 A 8/1986 Boyadjieff
4,793,422 A 12/1988 Krasnov
6,622,796 B1 9/2003 Pietras
6,679,333 B2 * 1/2004 York et al. ..... 166/379
6,725,938 B1 4/2004 Pietras
6,913,096 B1 * 7/2005 Nielsen et al. ..... 175/85
2003/0000742 A1 1/2003 Juhasz et al.

FOREIGN PATENT DOCUMENTS

CA 2390365 7/2002

OTHER PUBLICATIONS

Fluid Design Solutions Inc. Photo from a topdrive displayed at the Global Petroleum Show Calgary, Alberta Canada Jun. 8-10, 2004. www.fluid-design.ca Fluid Design Solutions Inc., FDS 250 Top Drive Last updated Jun. 20, 2004.
TESCO Corporation brochure for HCI Top Drive available prior to Nov. 9, 2004.

* cited by examiner

*Primary Examiner*—Frank S. Tsay
(74) *Attorney, Agent, or Firm*—Bennett Jones LLP

(57) ABSTRACT

A top drive assembly for wellsite operations may include a quill, a swivel including a swivel housing and a swivel bearing therein in which the quill is supported, a drive system for applying torque to the quill, and link arm hangers extending from the swivel housing and formed to accept and retain link arms.

42 Claims, 4 Drawing Sheets

TOP DRIVE ASSEMBLY

FIELD

The present invention is directed to a top drive assembly and a swivel therefor.

BACKGROUND

A top drive assembly is used in oilfield operations for manipulating a wellbore string such as a drill string or a casing or liner string. The top drive assembly is supported in a rig such as a mast or derrick for supporting and axially and rotationally driving the wellbore string.

Referring to FIG. 1, an example of a prior art top drive assembly is shown. The top drive assembly 10 may be supported from a hook in a rig (not shown) by use of a hoisting apparatus 12 such as a bail, links, blocks, etc., and may be stabilized by connection to a torque track 14. A top drive assembly generally may include a quill 16 that extends from the top drive assembly downwardly for connection directly, or indirectly as through a clamp 18 etc., to the wellbore string 20, a swivel 22 including a swivel bearing for rotationally supporting the quill, a torque and drive system 24 that may include, for example, a gear box 26 and motor 28 for applying torque to the quill, and link arms 30 with elevators 34 connected via link hangers 31 on a collar 32 and load nut 33 to the quill for supporting the weight of the wellbore string when the wellbore string is supported by the top drive assembly through elevators 34 but not connected to the quill.

In a typical configuration, as shown, swivel 22 is positioned adjacent the upper end of the top drive assembly with bail 12 connected to the swivel housing. Quill 16 is supported in the swivel and extends down through drive system 24 to extend out at the bottom of assembly 10. A typical top drive assembly may accommodate a space of about 20 ft (6 m) or more above from the top of the bail to the top of the link arm elevators.

In operations employing a top drive assembly; a load path is therefore set up from the wellbore string through the quill to the swivel and then to the bail through which the load is conveyed to the rig hoisting equipment. When the wellbore string is supported on the elevators, the load path extends through elevators 34 and link arms 30 to the load collar and the load nut and then up through the quill to swivel 22 and bail 12. A typical top drive assembly, therefore, effectively forms a single load path from top to bottom, which is through the quill.

Although the top drive assembly is an integral part of modern wellsite operations, the typical top drive configuration has presented problems with size and reliance on the quill in the load path.

SUMMARY

In accordance with one aspect of the present invention, there is provided a top drive assembly for wellsite operations, the top drive assembly comprising: a quill; a swivel including a swivel housing and a swivel bearing therein in which the quill is supported; a drive system for applying torque to the quill; and link arm hangers extending from the swivel housing and formed to accept and retain link arms.

A top drive assembly comprising: a quill; a swivel including a swivel housing and a swivel bearing therein for supporting the quill; and link arm hangers connected for load transfer to the swivel housing, the top drive assembly defining a first load path through the quill and the swivel and a second load path directly from the link hangers to the swivel.

A top drive assembly swivel comprising: a swivel housing and a swivel bearing therein, the swivel housing including a connector for accepting connection to a bail and link hangers extending therefrom.

BRIEF DESCRIPTION OF THE DRAWINGS

The invention may be better understood by reference to the drawings of prior art and possible embodiments, wherein.

DESCRIPTION OF VARIOUS EMBODIMENTS

Figure 1:
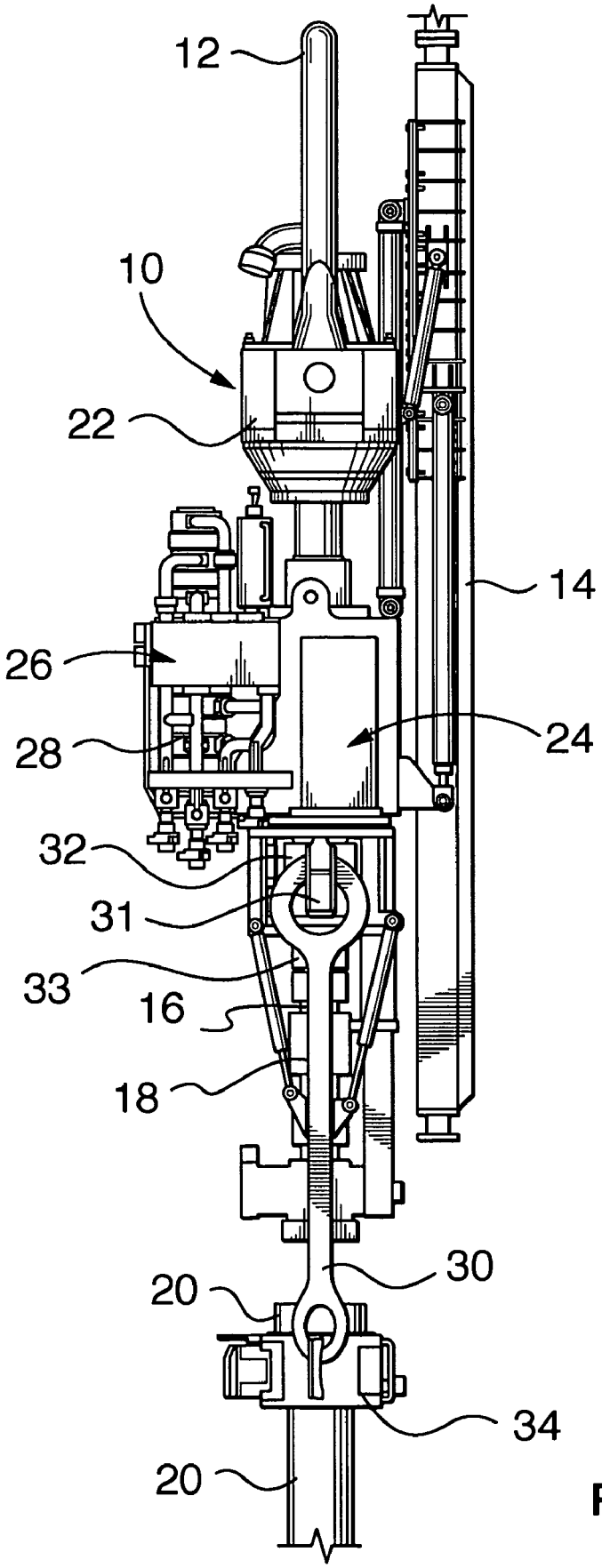
FIG. 1 PRIOR ART
FIG. 1 is a side elevation of a prior art top drive assembly.

A top drive assembly 50 is described herein that may be more compact and less complex that many previous top drive assemblies. The top drive assembly described herein offers a dual load path between a rig in which the assembly is mounted and a wellbore string 20 to be handled by the top drive assembly.

Top drive assembly 50 may be supported from a hook in a rig (not shown) by use of a hoisting apparatus such as links 52, a bail, etc. and may be stabilized by a bracket (not shown) for connection to a torque track.

Top drive assembly 50 includes a quill 56, a swivel 72 and link hangers 80. For operation to manipulate a wellbore string further parts such as a grabber, link arms 82 and a torque and drive system 94 may be provided and installed.

Quill 56 extends from the top drive assembly downwardly for connection directly or indirectly to the wellbore string 20. For example, in the illustrated embodiment, the quill has connected thereto a sub string 21, which in turn connects directly or indirectly to the wellbore string. Of course, other configurations may be possible such as, for example, including casing clamps, actuators, valves, etc. Wellbore string 20 may be one or more joints of pipe such as, for example, any of drill pipe, drill collar, casing or a wellbore liner.

Top drive assembly 50 further includes a swivel 72, including a housing 73 containing a swivel bearing 74 for supporting quill 56 in a manner permitting rotation therein. The swivel also provides connection directly or indirectly to links 52. For example, in the illustrated embodiment, swivel housing 73 has formed thereon devises 75 for accepting pins 76 connecting between the links and the swivel. Of course, other connection arrangements are possible between the top drive hoisting apparatus and the swivel. However, any such connection should be selected with consideration as to the load that must be accommodated therethrough.

Top drive assembly 50 also includes link hangers 80 for accepting and retaining link arms 82 and, therethrough, elevators 84. Link hangers 80 form support areas for the link arms.

In the illustrated embodiment, the link hangers are hooked extensions over which the eyes 83 of link arms 82 may be hooked. As will be appreciated, a pair of link hangers 80 is usually employed and the link hangers are usually diametrically positioned so that the link arms hang down on either side of the top drive.

The swivel 72 and link hangers 80 configuration provide that the link hangers 80 extend from swivel housing 73 rather than from a connection to the quill. Link hangers 71 can be formed or mounted in various ways to extend from the swivel housing. For example, the link hangers can be formed integral with the swivel housing, as shown. Alternately, the link hangers can be connected to the swivel housing by way of welding, bolts or other fasteners, connectors, interlocking arrangements, bearings, etc. Any connection arrangement between the link hangers and the swivel housing, however, must be selected with consideration as to the load that must be accommodated therethrough.

During certain operations using the top drive assembly, the weight of the wellbore string will be taken up by the elevators and the link arms and during certain other operations, the weight of the wellbore string will be taken up by the quill. In the present top drive assembly, when the load is taken up by the link arms, such load is transferred through the link arms and the link hangers to the swivel housing and then to the bail. As such, the top drive assembly offers a dual load path including a first load path through quill 56 and swivel 72 into the bail and a second load path through link arms 82, link hangers 80 and swivel 72 into the bail. In this assembly, therefore, the weight can be carried by the link arms and the quill may be free for other operations, which may, for example, include rotation of the quill.

Figure 2:
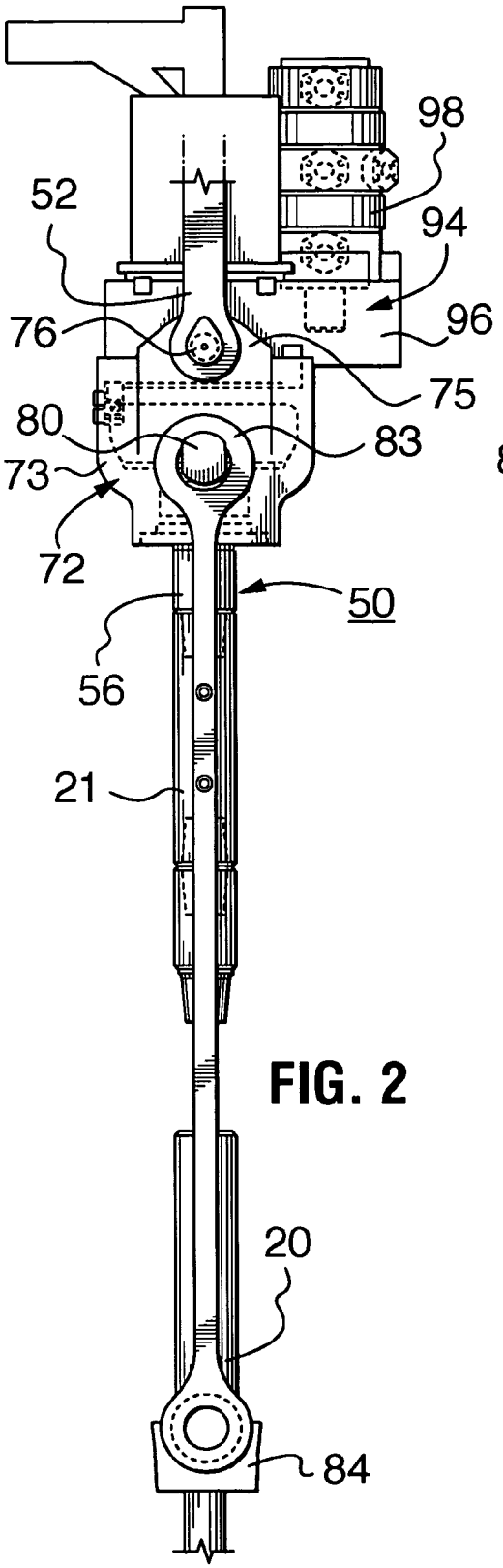
FIG. 2 is a side elevation of one embodiment of a top drive assembly according to the present invention.
Figure 3:
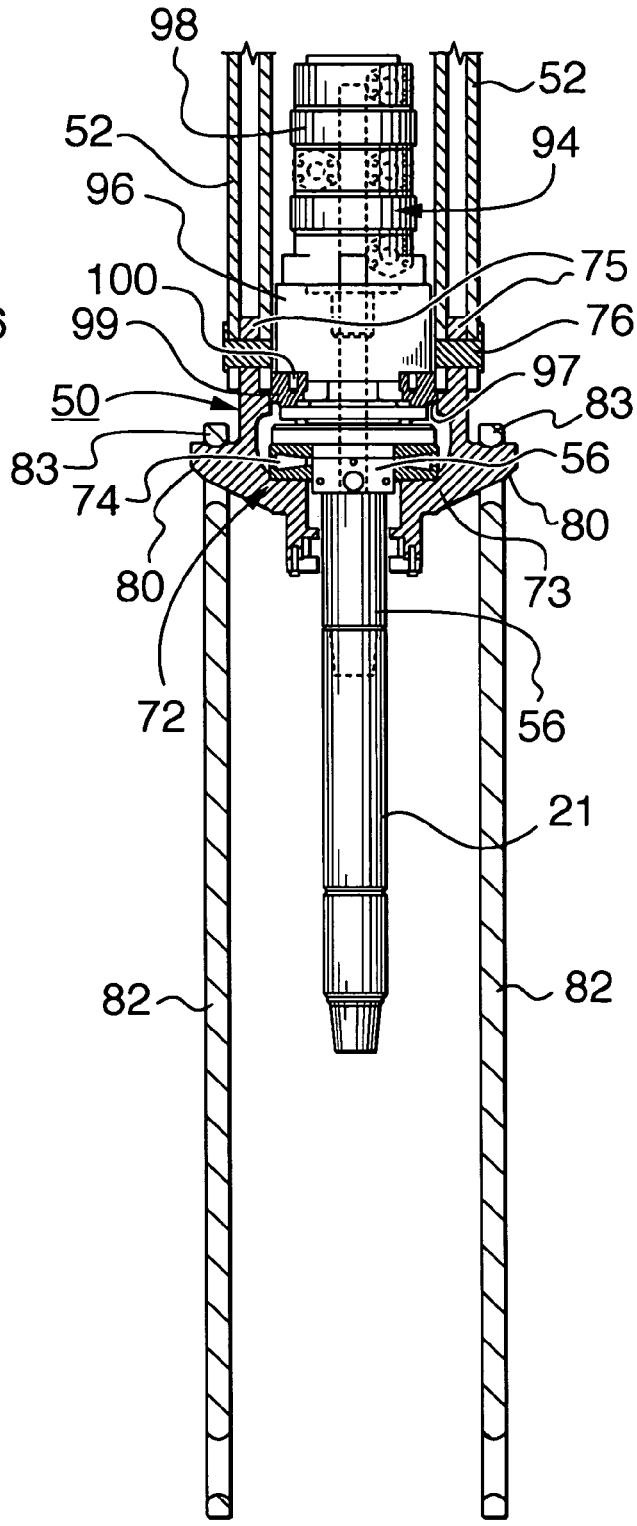
FIG. 3 is a front elevation of the top drive assembly of FIG. 2 with a portion of the swivel shown in section.

Top drive assembly 50, for operation, also includes a torque and drive system 94 for applying torque to the quill. In the illustrated embodiment, for example, the torque and drive system includes a gear box 96 in a concentric or eccentric configuration and any of various types of motors 98. Torque and drive system 94 may be positioned in various locations on the top drive assembly, for example above or below the swivel, to drive the quill. In the illustrated embodiment, torque and drive system 94 is positioned above swivel 72. As such, the torque and drive system is out of the way so that the quill and the link arms do not have to be formed to accommodate the system 94. In particular, this permits the quill and the link arms to be shorter than in a top drive assembly where the torque and drive system is positioned below the swivel. For example, in one embodiment a top drive assembly similar to that of FIG. 2 may accommodate a reduced space between the top of the links and the bottom of the quill, when compared to a top drive as shown in FIG. 1.

In addition, the torque and drive system, in its position above swivel, is out of the load path and need not, if desired, accommodate a structure in the load path passing therethrough.

Torque and drive system 94 may be connected permanently or detachably into the top drive assembly. For example, in the illustrated embodiment, the gearbox of the system is detachably connected to a support surface 97 on swivel 72 via a connector 99 and bolts 100. This detachable connection permits the torque and drive system to be removed from the top drive assembly for repair or replacement, for example, for selection to meet desired operational parameters. In one embodiment, the drive assembly connects to the quill via a spline or another drive interface.

In one embodiment, torque and drive system 94 and swivel 72 may have a separate lubricant/oil storage and supply and may each be sealed independently of the other such that they can be readily separated without consideration as to leakage or containment of oil/lubricant.

Figure 4:
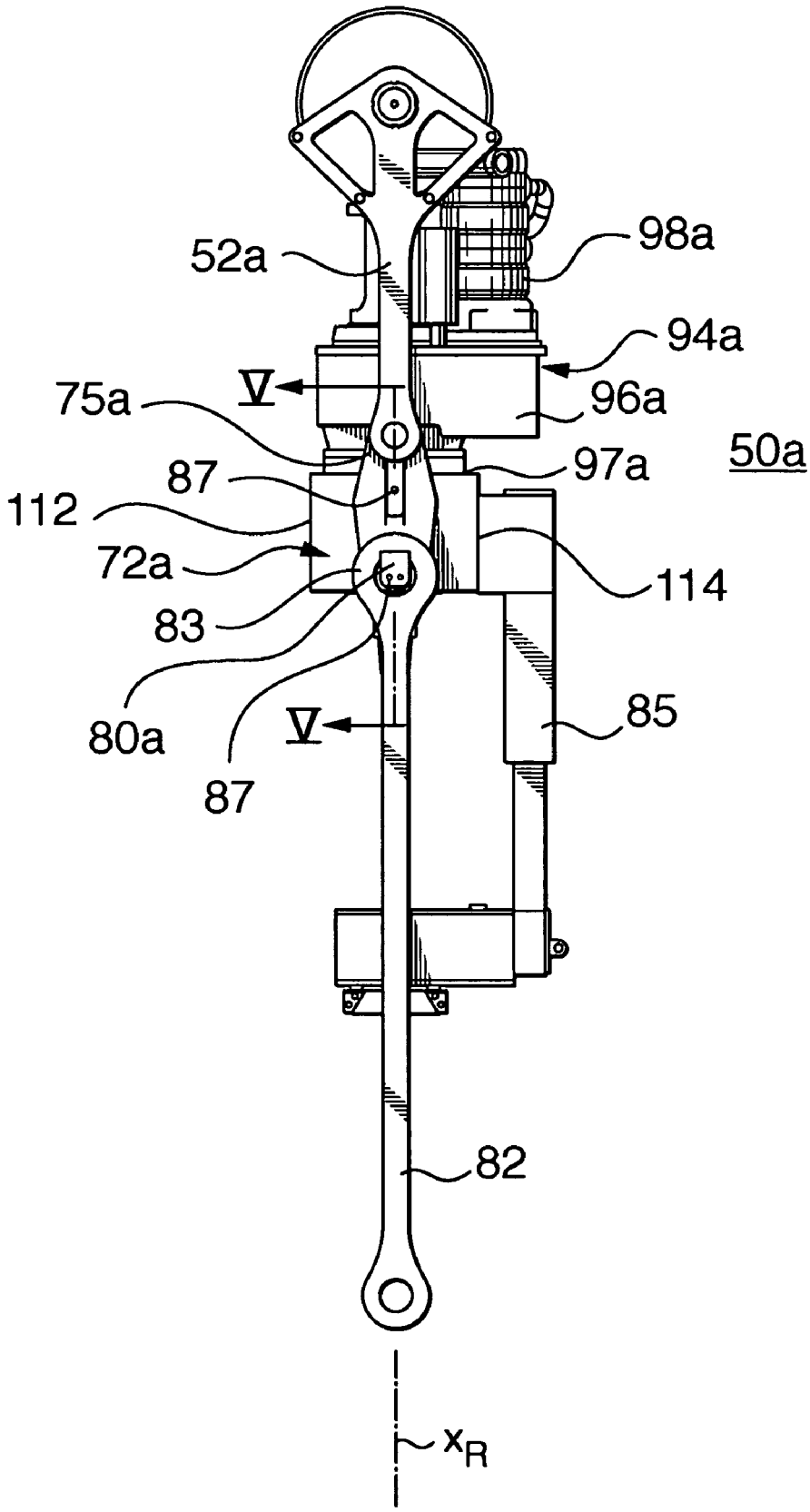
FIG. 4 is a side elevation of another embodiment of a top drive assembly.
Figure 5:
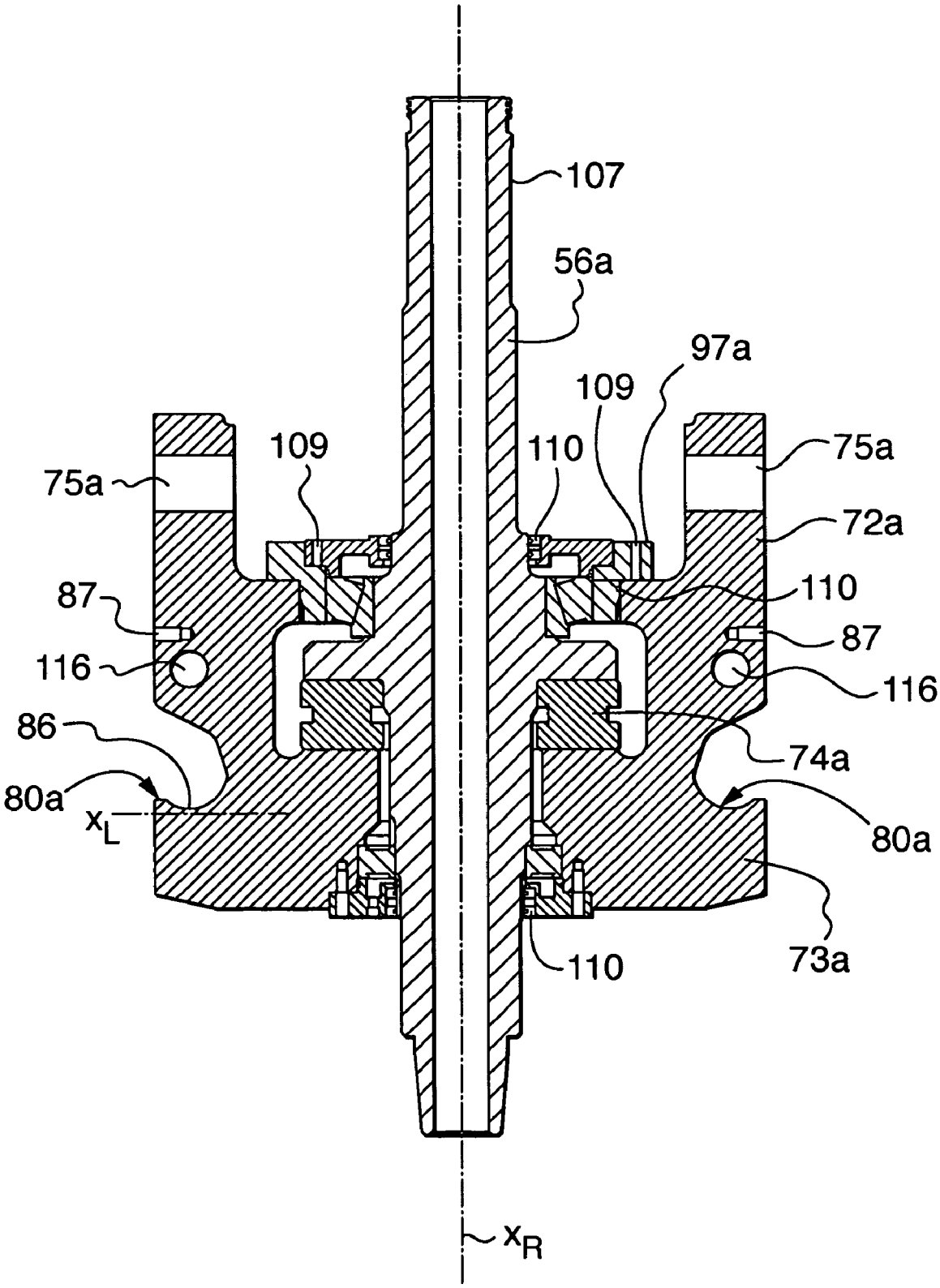
FIG. 5 is a section of the swivel and quill of FIG. 4 along lines V—V of FIG. 4.

Referring to FIGS. 4 and 5, another top drive assembly 50*a* and swivel 72*a* are shown. Top drive assembly 50*a* includes a quill 56*a*, a swivel 72*a*, link hangers 80*a*, a pipe grabber assembly 85, link arms 82 and a torque and drive system 94*a*.

As in previous embodiments, quill 56*a* extends through the swivel and extends downwardly out from the swivel for connection directly or indirectly to a wellbore string. Swivel 72*a* includes a housing 73*a* containing a swivel bearing 74*a* for supporting quill 56*a* and permitting its rotation about axis $x_R$. The swivel also provides connections 75*a* for directly or indirectly securing to hoisting apparatus such as links and block 52*a*.

Link hangers 80*a* are formed from housing 73*a* integral with the material of housing, as by molding or machining. As noted hereinbefore, link hangers 80*a* support link arms 82.

Link hangers 80*a* form support areas for the link arms. In the illustrated embodiment, the link hangers are defined by pockets formed in the swivel housing to accommodate the eyes 83 of the link arms 82 and supports 86 over which the eyes may be hooked. Supports 86 define a saddle-shaped upper surface including a concave curvature over their long axis $x_L$, which is that axis substantially radial to the rotational axis of the top drive assembly, and a convex curvature over an axis perpendicular to axis $x_L$. Such a surface curvature forms a saddle-shaped support surface that substantially envelopes the load transfer surface of an eye 83 to enhance contact, and thereby load transfer, therebetween. Apertures 87 are formed to accept fasteners for securing a stay plate (not shown) over the pockets to maintain the eyes in the pockets.

Top drive assembly 50*a* also includes a torque and drive system 94*a* for applying torque to the quill. In the illustrated embodiment, for example, the torque and drive system includes a gear box 96*a* and a motor 98*a*, each of which may be selected from various configurations and types. In the illustrated embodiment, torque and drive system 94*a* is positioned above swivel 72*a*. Torque and drive system 94*a* may be connected permanently or detachably into the top drive assembly. For example, in the illustrated embodiment, the torque and drive system 94*a* is detachably connected to a support surface 97*a* on swivel 72*a* and the gears of the gearbox are connected to the quill by a releasable spline interface 107. Support surface 97*a* includes holes 109 for retaining bolts (not shown) to connect the torque and drive system. This detachable connection permits the torque and drive system to be removed from the top drive assembly for repair or replacement. Seals 110 may be provided to contain the swivel's lubricant supply.

The swivel housing may be formed to accommodate other modular components. For example, in the illustrated embodiment, the swivel housing defines a back interface surface 112 including fastener holes onto which a torque track or other component may be connected. The illustrated swivel further includes a front interface surface 114 including fastener holes for retaining grabber assembly 85 or another component. Swivel 72*a* may also include interface apertures 116 for permitting a pull down connection. As such, the swivel may be modular such that any of various parts, including for example, any or all of system 94*a*, grabber assembly 85, a torque track or pull down apertures 116, can be selected and connected to swivel housing 73, as desired.

Suitable materials and construction for a top drive assembly and components would be apparent to a skilled workman.

While various embodiments have been described in detail, these embodiments are described to facilitate understanding and are not intended to be used to limit the invention. It is to be understood that a substitutions would be apparent to a skilled workman and such substitutions are to be encompassed by the appended claims.

We claim:

1. A top drive assembly for wellsite operations, the top drive assembly comprising: a quill; a swivel including a swivel housing and a swivel bearing therein in which the quill is supported; a drive system for applying torque to the quill; and link arm hangers extending from the swivel housing and formed to accept and retain link arms.

2. The top drive assembly of claim 1 wherein the link arm hangers are formed integral with the swivel housing.

3. The top drive assembly of claim 1, the drive system being positioned above the swivel.

4. The top drive assembly of claim 1 wherein the drive system is detachably connected to the swivel.

5. The top drive assembly of claim 1 further comprising a grabber assembly detachably connected to the swivel.

6. A top drive assembly comprising: a quill; a swivel including a swivel housing and a swivel bearing therein for supporting the quill; and link arm hangers connected for load transfer to the swivel housing, the top drive assembly defining a first load path through the quill and the swivel and a second load path directly from the link hangers to the swivel.

7. The top drive assembly of claim 6 further comprising a link arm connected on each link hanger and the second load path extends from link arms to the link arm hangers.

8. The top drive assembly of claim 6 wherein the drive system is operable to drive the quill with a load passing through the first load path.

9. The top drive assembly of claim 6 wherein the drive system is operable to drive the quill while a load passes through the second load path.

10. The top drive assembly of claim 6 further comprising a connection on the swivel housing to a top drive hoisting apparatus.

11. A top drive assembly for wellsite operations, the top drive assembly comprising: a quill; a swivel including a swivel housing and a swivel bearing therein in which the quill is supported; a drive system for applying torque to the quill; and a drive system support surface on the swivel housing and formed to detachably connect the drive system.

12. The top drive assembly of claim 11 wherein the swivel and the drive system each include separate lubricant supplies.

13. The top drive assembly of claim 11 wherein the swivel and the drive system each are separately sealed.

14. The top drive assembly of claim 11 wherein the quill and drive system are releasably connected by a spline interface.

15. The top drive assembly of claim 11 further comprising a front interface surface on the swivel housing for detachably connecting a grabber assembly.

16. The top drive assembly of claim 11 further comprising a rear interface surface on the swivel for detachable connection of a torque track.

17. The top drive assembly of claim 11 further comprising a pull down interface formed on the swivel housing.

18. The top drive assembly of claim 11 further comprising a pair of link hangers formed integral with the swivel housing.

19. A top drive assembly swivel comprising: a swivel housing and a swivel bearing therein, the swivel housing including a connector for accepting connection to a string hoisting apparatus and a pair of link arm hangers extending therefrom.

20. The top drive assembly swivel of claim 19 further comprising a drive system support surface positioned on top of the swivel housing.

21. The top drive assembly swivel of claim 20 wherein the drive system support surface includes bolt holes for detachably connecting the drive system.

22. The top drive assembly swivel of claim 19 further comprising a front interface surface on the swivel housing for detachably connecting a grabber assembly.

23. The top drive assembly swivel of claim 19 further comprising a rear interface surface on the swivel for detachable connection of a torque track.

24. The top drive assembly swivel of claim 19 further comprising a pull down interface formed on the swivel housing.

25. The top drive assembly swivel of claim 19, the pair of link hangers being formed integral with the swivel housing.

26. The top drive assembly swivel of claim 19 wherein at least one of the pair of link arm hangers includes a saddle-shaped support surface including a concave curvature over its long axis and a convex curvature over an axis perpendicular to the long axis.

27. A top drive assembly for wellsite operations, the top drive assembly comprising: a quill; a swivel including a swivel housing and a swivel bearing in the swivel housing, the quill being supported by the swivel bearing; a drive system for applying torque to the quill; and link arm hangers extending directly from the swivel housing and formed to accept and retain link arms.

28. The top drive assembly of claim 27 wherein the link arm hangers are formed integral with the swivel housing.

29. The top drive assembly of claim 27 wherein the swivel housing includes a wall including an inner facing surface open to the swivel bearing and an outer surface from which the link arm hangers extend.

30. The top drive assembly of claim 29 wherein the link arm hangers are positioned on the outer surface directly opposite the inner facing surface on which the swivel bearing is supported.

31. The top drive assembly of claim 27 further comprising string hoisting apparatus connectors on the swivel housing.

32. The top drive assembly of claim 27 further comprising a grabber assembly detachably connected to the swivel.

33. A top drive assembly comprising: a quill; a swivel including a swivel housing having an inner facing surface and an outer surface and a swivel bearing for supporting the quill, the swivel bearing being positioned within the inner facing surface of the swivel housing; and link arm hangers connected to the outer surface of the swivel housing for load transfer directly to the swivel housing, the top drive assembly defining a first load path through the quill and the swivel and a second load path directly from the link hangers to the swivel housing.

34. The top drive assembly of claim 33 further comprising a link arm connected on each link hanger and the second load path extends from link arms to the link arm hangers.

35. The top drive assembly of claim 33 wherein the drive system is operable to drive the quill while a load passes through the second load path.

36. The top drive assembly of claim 33 further comprising a top drive hoisting apparatus connection on the swivel housing.

37. A top drive assembly swivel comprising: a swivel housing and a swivel bearing therein, the swivel housing including a connector for accepting connection to a string hoisting apparatus and a pair of link arm hangers positioned on the swivel housing directly opposite the swivel bearing.

38. The top drive assembly swivel of claim 37 further comprising a front interface surface on the swivel housing for detachably connecting a grabber assembly.

39. The top drive assembly swivel of claim 37 further comprising a rear interface surface on the swivel for detachable connection of a torque track.

40. The top drive assembly swivel of claim 37 further comprising a pull down interface formed on the swivel housing.

41. The top drive assembly swivel of claim 37 wherein the pair of link hangers is formed integral with the swivel housing.

42. The top drive assembly swivel of claim 37 wherein at least one of the link arm hangers includes a saddle-shaped support surface including a concave curvature over its long axis and a convex curvature over an axis perpendicular to the long axis.

* * * * *